US007010818B1

(12) United States Patent
Hall

(10) Patent No.: US 7,010,818 B1
(45) Date of Patent: Mar. 14, 2006

(54) PORTABLE SHAMPOO SINK

(76) Inventor: Judy Terry Hall, 2162 Broad Street Rd., Maidens, VA (US) 23102

( * ) Notice: Subject to any disclaimer, the term of this patent is extended or adjusted under 35 U.S.C. 154(b) by 0 days.

(21) Appl. No.: 11/085,946

(22) Filed: Mar. 22, 2005

Related U.S. Application Data

(60) Provisional application No. 60/555,651, filed on Mar. 24, 2004.

(51) Int. Cl.
*A45D 44/08* (2006.01)

(52) U.S. Cl. ..... 4/521

(58) Field of Classification Search ..... 4/515, 4/516, 519, 520, 521
See application file for complete search history.

(56) References Cited

U.S. PATENT DOCUMENTS 1,429,950 A 9/1922 Jones et al.
1,612,602 A * 12/1926 Bowman ..... 4/521
2,243,505 A * 5/1941 Mercer ..... 2/50
4,014,054 A 3/1977 Pasquarello
5,146,629 A * 9/1992 Barnes ..... 2/174
5,551,088 A * 9/1996 Stepp ..... 2/174
D375,385 S * 11/1996 Mock ..... D28/20
5,940,885 A * 8/1999 Matthews ..... 2/174
5,946,745 A 9/1999 Magee
6,415,458 B1 7/2002 McFadden

* cited by examiner

*Primary Examiner*—Justine R. Yu
*Assistant Examiner*—Huyen Le

(57) ABSTRACT

A portable shampooing sink having: a semi-rigid annular ring having a front and a rear as defined by location about the neck of a user; a neck closure inside of the semi-rigid annular ring; a skirt intermediate the semi- rigid annular ring and the neck closure; and a drain located at the rear. According to certain preferred embodiments, the semi-rigid annular ring is a split ring defining an opening, the skirt includes a slit that provides access between the opening in the split ring and the neck closure and the neck closure is a tube having a smooth exterior surface and a padded interior for comfort.

4 Claims, 3 Drawing Sheets

PORTABLE SHAMPOO SINK

This application claims benefit of Provisional Patent Application Ser. No. 60/555,651 filed Mar. 24, 2004 of common inventorship herewith.

FIELD OF THE INVENTION

The present invention relates to hairdressing apparatus and more particularly to a portable shampoo sink that simplifies handling of excess water present during the shampooing of the hair.

BACKGROUND OF THE INVENTION

In the conventional washing or shampooing of the hair of one person by another, for example in a beauty salon, barber shop or the like, the conventional method is for the client or party having their hair washed to tilt back in a chair and place the head over the lip of a sink that generally contains a depression for receipt of the neck. While such an operation is generally acceptable, there exist numerous situations where such positioning of the client is not possible or convenient. Some examples of such cases are physically handicapped or aged persons who cannot perform the required head and neck manipulation, but rather must sit virtually upright during the shampooing operation, shampooing performed in the home where a chair of appropriate height or design and/or a sink of appropriate height or design may not be available. In all of these situations it is not unusual for the person whose hair is being washed to become soaked with water that pours off of the head during shampooing or other hair dressing operations such as perming that involve wetting the clients hair.

A number of solutions to the problem just described have been proposed in the prior art, but none of these provides an acceptable solution to the problem. For example, U.S. Pat. No. 6,451,458 issued Jul. 9, 2002 to McFadden describes a portable shampooing that includes a basin defining a central opening and a sleeve of elastic, liquid impermeable material. The sleeve defines a first periphery joined to the basin around the opening for admitting passage of a human head. The sleeve also defines a second periphery smaller than the first for fitting around a human neck, preferably at or just below the chin. Optionally, the basin includes a funnel portion and drainage tube. While the device of McFadden is aimed at solving the described problem, it has several shortcomings. Firstly, in the case of a client receiving a perm, it would be virtually impossible of extremely difficult to pass the device over the head of the client whilst "perm rods" or other hair curling apparatus. The device of McFadden has the drain extending from the font of the device, a configuration that would make it most difficult to properly orient a client with respect to a sink or other drain apparatus, especially if the client were in, for example, a wheel chair. Finally, the device of McFadden incorporates a so-called shield that extends upwardly behind the client's head to capture overspray. According to McFadden, the shield preferably extends 10 inches above the bottom wall of the device. The presence of such a shield would virtually prohibit the hairdresser to have adequate access to the rear of the head to properly shampoo or otherwise treat the hair of a user.

Other similar such devices are described in U.S. Pat. No. 5,946,745 to Magee, U.S. Pat. No. 1,429,950 to Jones et al. and U.S. Pat. No. 4,014,054 to Pasquarello. While all of these devices attempt to solve the same asic problem addressed herein, each of them suffers from one or more of the following problems: they are bulky, they require tilting of the head backward, they require elasticized insertion of the head etc.

Thus, there remains a need for a portable shampooing basin or sink that allows for the comfortable washing or treatment of the hair of persons exhibiting limited movement capabilities or confined to some situation where appropriate access to a sink or other drainage device is readily available, for example, due to confinement to a wheel chair.

OBJECT OF THE INVENTION

It is therefore an object of the present invention to provide a portable shampooing sink that is comfortable and can be readily applied to the body of a client in a condition where the use of conventional shampooing sinks is not a viable option without significantly wetting the client.

SUMMARY OF THE INVENTION

According to the present invention there is provided a portable shampooing sink comprising: a semi-rigid annular ring having a front and a rear as defined by location about the neck of a user; a neck closure inside of the semi-rigid annular ring; a skirt intermediate the semi-rigid annular ring and the neck closure; and a drain located at the rear. According to certain preferred embodiments, the semi-rigid annular ring is a split ring defining an opening, the skirt includes a slit that provides access between the opening in the split ring and the neck closure and the neck closure is a tube having a smooth exterior surface and a padded interior for comfort.

DETAILED DESCRIPTION

Figure 1:
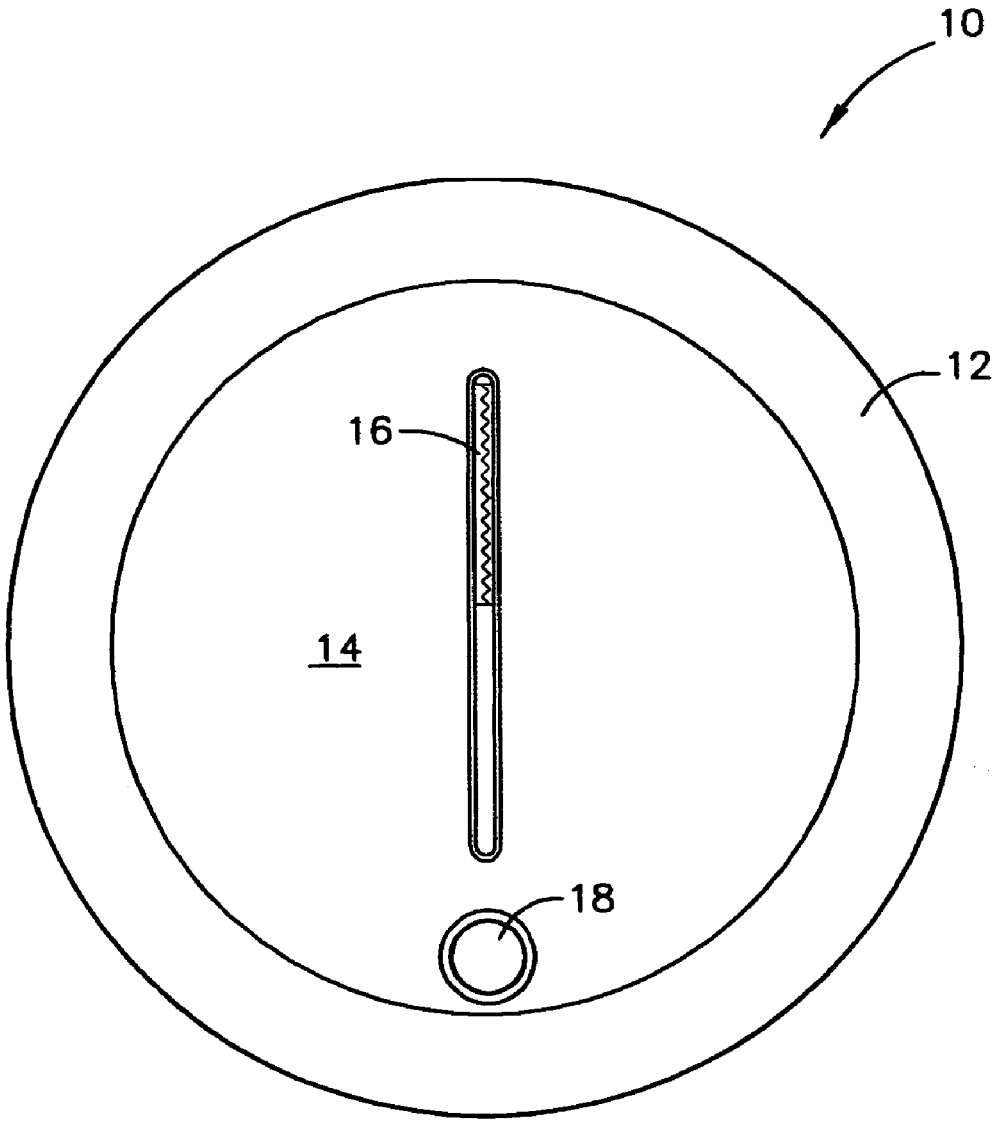
FIG. 1 is a top plan view of one embodiment of the portable shampoo sink of the present invention.
Figure 2:
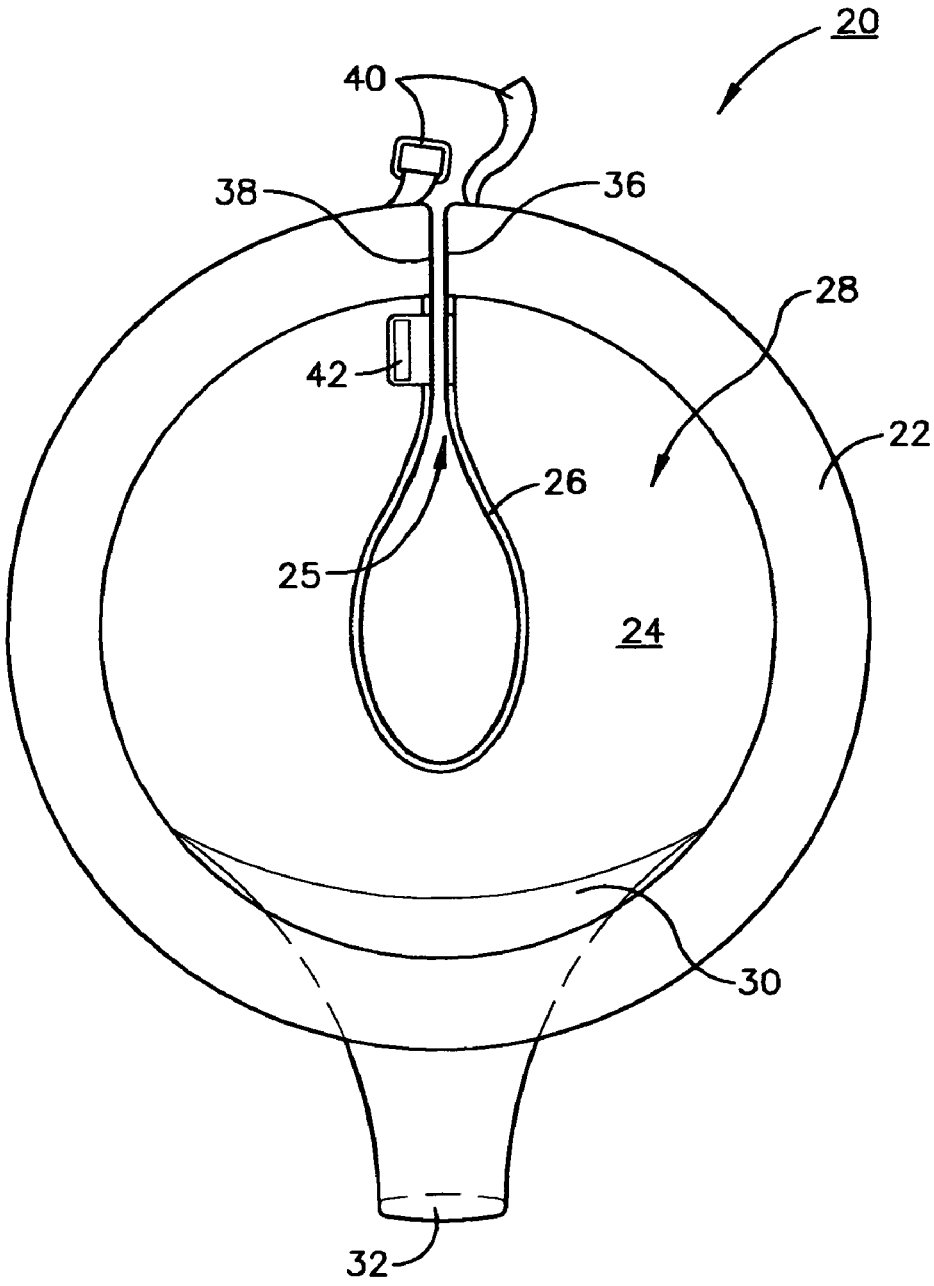
FIG. 2 is a top plan view of an alternative preferred embodiment of the portable shampoo sink of the present invention.
Figure 3:
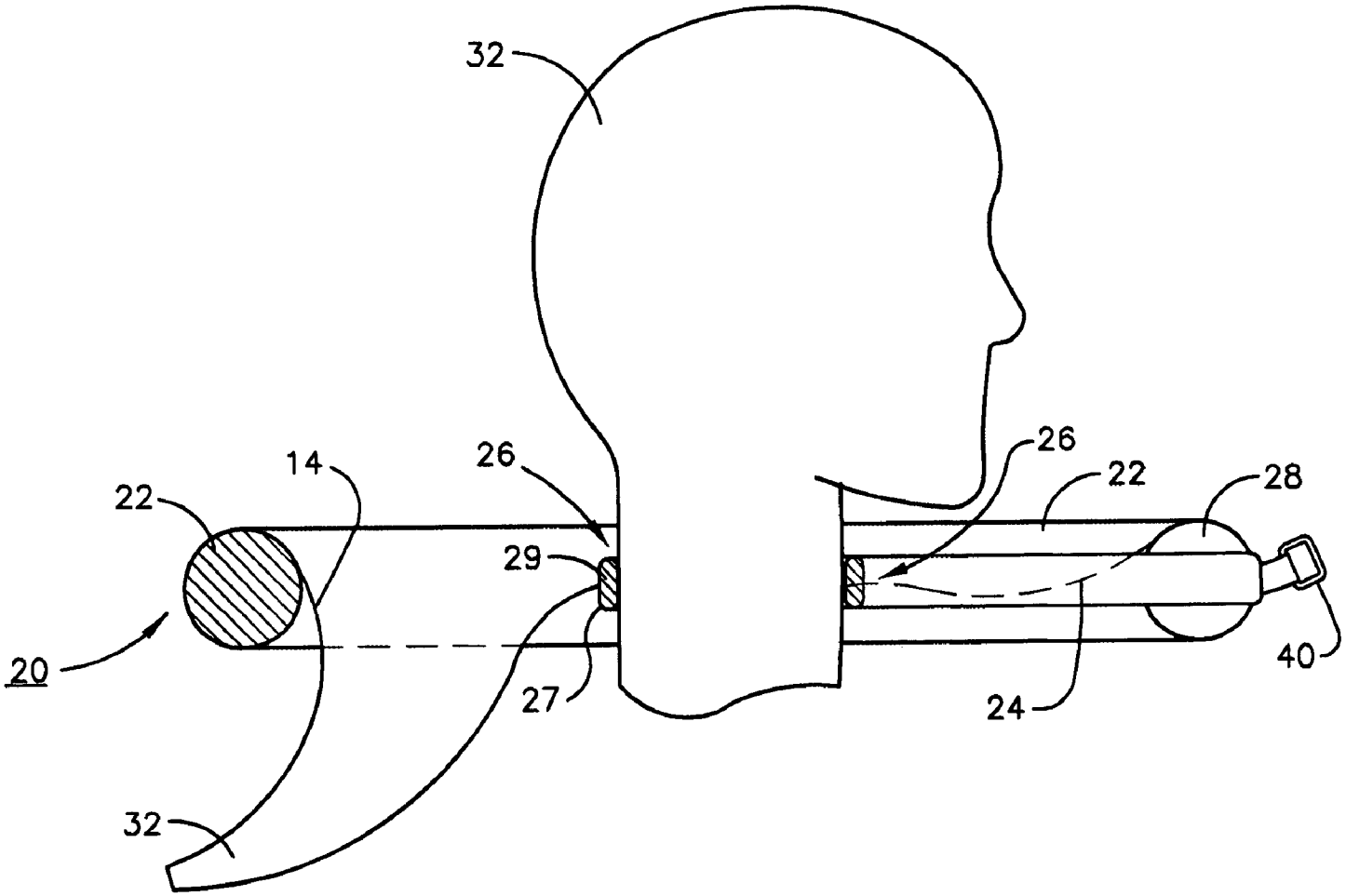
FIG. 3 is a partially cross-sectional side view showing the portable shampoo sink of FIG. 2 about the neck of a user.

Referring now to the accompanying Figures wherein FIGS. 1 and 2 depict top plan views of alternative preferred embodiments of the portable shampoo sink of the present invention and FIG. 3 depicts a partially cross-sectional view of the shampoo sink of FIG. 2, the following discussion will describe the common features of both embodiments followed by a review of the differences between the two embodiments.

Referring now specifically to FIG. 1 that depicts a top plane view of a first embodiment of the portable shampoo sink 10 of the present invention, according to this embodiment, shampoo sink 10 comprises a semi-rigid annular ring 12, a neck closure 16 and a skirt 14 that extends between first annular ring 12 and neck closure 16. Skirt 14 lies in a plane preferably at or near the base of annular ring 12 but below the upper surface thereof and serves to collect any water falling from the head of a user and guides it to drain hole 18 located toward the rear of portable shampoo sink 10. In this embodiment, neck closure 16 preferably includes a hook and loop or so-called Velcro® fastener or zipper as a fastener that allows for adjustment of neck closure 16 about necks of varying sizes.

While the portable shampoo sink of FIG. 1 provides a satisfactory device for the intended use in many situations, from the comfort and ease of use perspectives it has some short comings such as the difficulty of placing or removing over the head of a user when the user is averse to such application or hair curling or other hairdressing apparatus is in place, and the relative discomfort about the neck due to the use of a hook and loop fastening system for adjustable application.

In order to overcome these relative shortcomings the alternative embodiment of the portable shampoo sink 20 of the present invention has been developed. As shown in FIG. 2, according to this embodiment, shampoo sink 20 comprises a semi-rigid annular ring 22, a second smaller annular ring that serves as the neck enclosure 26 in this embodiment and a skirt 24 similar to that described in connection with skirt 14 above that connects semi-rigid annular ring 22 with neck closure 26. In this embodiment, while skirt 24 is relatively planar toward the front area 28, rear area 30 of skirt 24 is tapered downward toward a drain 32, best seen in FIG. 3 that is a partially cross-sectional view of the portable shampoo sink of FIG. 2. In this embodiment, water or other liquid falling from the head of a user (34 in FIG. 3) is captured by skirt 24 and guided by tapered area 30 to drain 32 for removal from portable shampoo sink 20.

A particular distinction between the embodiment depicted in FIG. 1 and that depicted in FIGS. 2 and 3 lies in the design of the neck closure 26. In the embodiment depicted in FIGS. 2 and 3, semi-rigid annular ring 22 is a split ring that can be opened to separate opposing ends 36 and 38 and skirt 24 includes an elongated mating slit 25 that can be similarly separated for application of neck closure 26 about the neck of a user 34 and then closed by bringing opposing ends 36 and 38 back together and fastening them in proximity with a fastening mechanism 40 which may be a hook and loop fastener, a buckle or other similar device. According to this embodiment, neck closure 26 preferably comprises a second inner annular ring that is "rounded" as opposed to "flat" as in the case for neck closure 16 of FIG. 1, and includes a smooth, liquid tight surface 27 and padding 29 for increased comfort for the user. Such a smooth, liquid tight surface could be provided by the use of a tubular structure of PVC or rubber filled with a suitable resilient foam to provide the desired comfort and liquid tightness. To permit adjustability of neck closure 26, some adjustable closure mechanism 42, for example one or more spaced apart hook and loop straps that can be secured to the opposing outer surfaces of mating slit 25 along the length thereof can be provided or one or more straps and buckles can be similarly provided to accomplish the same function. By the proper selection of adjustable closure mechanism 42, the tightness of neck closure 26 about the neck of a user can be adjusted.

Among the many common features of the embodiments of FIG. 1 and FIGS. 2 and 3, are the following: semi-rigid annular rings 12 and 22 may be fabricated from a polymer foam or other flexible/semi-rigid material or comprise inflatable tubes which are similarly flexible/semi-rigid but can be collapsed for storage or transportation; skirts 14 and 24 comprise a water or other liquid proof material such as PVC, rubber, etc. and may be transparent, colored or decoratively adorned; skirts 14 and 24 are attached to semi-rigid annular rings 12 and 22 below the top of these structures to provide a "basin" structure for the receipt of liquid, as best seen in FIG. 3; whichever neck closure structure 16 or 26 is used, skirts 14 and 24 must be attached thereto in a location that inhibits the passage of liquid from skirts 14 and 24 to the neck of the user; and drains 32 and 18 located in the rear area 30 may include whatever connectors, extensions etc. may be required to achieve proper drainage to a remotely located fixed sink or other drain. According to a highly preferred embodiment skirts 14 and 24 are fabricated from a flexible material such as PVC, rubber or some other flexible natural or synthetic material.

Fabrication of portable shampoo sinks 10 and 20 will of course depend largely upon the materials used to construct them. In the case where they are fabricated from PVC or another suitable polymeric material heat sealed or welded joints may be used to join the various portions thereof. In other situations where dissimilar materials are used for individual portions glued joints may be provided.

As used herein, the term "semi-rigid" is meant to define a structure that can be flexed and bent but is sufficiently rigid as to be self supporting such that semi-rigid annular rings 12 and 22 retain their shape and relative planarity when placed about the neck of a user and do not collapse so as to permit liquid falling onto skirts 14 and 24 to pass over annular rings 12 and 22 or neck closures 16 and 26.

In use, the portable shampoo sink of FIG. 1 is placed about the neck of a user by passage of neck closure 16 over the head of the user. In the case of the preferred embodiment depicted in FIGS. 2 and 3, the portable shampoo sink is applied about the neck of the user by spreading ends 36 and 38 and slit 25, inserting the neck of the user into the opening between ends 36 and 38, through slit 25 and into neck closure 26 and then securing mechanism 40 and optionally straps 44 and 46 for proper fit.

There has thus been described a portable shampoo sink that is easy to apply to the neck of a user, is comfortable while applied and provides excellent protection of the user from being wet by liquids applied to the head of the user.

As the invention has been described, it will be apparent to those skilled in the art that the same may be varied in many ways without departing from the spirit and scope thereof. Any and all such modifications are intended to be included within the scope of the appended claims.

What is claimed is:

1. A portable shampooing sink comprising:

A) a semi-rigid split annular ring having a front and a rear as defined by location about the neck of a user and an opening at the front of the split annular ring defining opposed ends;

B) a split ring neck closure inside of the semi-rigid annular ring for engagement about the neck of a user;

C) a skirt intermediate the semi-rigid split annular ring and the neck closure including a slit having opposed elongated edges that provide access between the neck closure and the opening in the split annular ring; and D) a drain located at the rear of the skirt.

2. The portable shampooing sink of claim 1 further including a fastening mechanism for adjusting the neck closure about the neck of a user.

3. The portable shampooing sink of claim 2 further including a mechanism for securing the opposing ends together and a mechanism for adjustably maintaining the elongated edges together.

4. The portable shampooing sink of claim 1 wherein the neck closure comprises an inner annular split ring having a smooth exterior surface and a padded interior surface.

* * * * *